US005779350A

United States Patent [19]

Chang

[11] Patent Number: 5,779,350

[45] Date of Patent: Jul. 14, 1998

[54] HAND TOOL CASE WITH DETACHABLY CONNECTED WORKING LIGHT

[75] Inventor: Cheng-Chen Chang, Sanchung, Taiwan

[73] Assignee: Caster Lighting Inc., Taipei Hsien, Taiwan

[21] Appl. No.: 898,687

[22] Filed: Jul. 22, 1997

[51] Int. Cl.[6] ..... F21V 33/00

[52] U.S. Cl. ..... 362/154; 362/253; 362/287; 362/427

[58] Field of Search ..... 43/17.5; 362/154, 362/155, 234, 253, 376, 427, 156, 287

[56] References Cited

U.S. PATENT DOCUMENTS

| | | | |
|---|---|---|---|
| 5,418,701 | 5/1995 | Hart | 362/376 |
| 5,459,648 | 10/1995 | Courtney | 362/154 |
| 5,624,029 | 4/1997 | Shih | 206/372 |

*Primary Examiner*—Stephen F. Husar

*Attorney, Agent, or Firm*—Beveridge, DeGrandi, Weilacher & Young LLP

[57] ABSTRACT

Disclosed is a hand tool case with a detachably connected working light. The working light is connected to a mounting bracket which is in turn connected to a movable frame pivotally connected to the hand tool case. The movable frame can be turned between a horizontal position in the hand tool case and an upright position protruding beyond the case. When the movable frame is in the horizontal position, the working light connected thereto can be located in the hand tool case for save storage therein. And, when the movable frame is in the upright position, the working light can be angularly adjusted relative to the mounting bracket to provide light in a desired manner. A shallow container for accommodating various parts can be removably positioned in the hand tool case while serves as an additional means to securely hold the upright movable frame in place. The working light can be removed from the mounting bracket and connected to other holding appliances for clamping on or hanging from a suitable place to advantageously provide light in different work sites.

4 Claims, 9 Drawing Sheets

HAND TOOL CASE WITH DETACHABLY CONNECTED WORKING LIGHT

FIELD OF THE INVENTION

The present invention relates to a hand tool case with a detachably connected working light, and more particularly to a hand tool case which has solid structure and is convenient for use. Various kinds of hand tools and hardware stored in the case and a working light angular adjustably connected thereto can be easily accessed to facilitate parts repair and maintenance at any place at any time with sufficient light provided by the working light.

BACKGROUND OF THE INVENTION

In repair or maintenance of large-scaled machines and tools or vehicles, there are many inner or deep areas on these items that can not be reached by light from general fixedly mounted lighting fixtures. There are working lights developed for use at any place to lighten areas that require careful examination and/or repair. Such movable working lights are indeed very convenient for use in many different fields and are particularly welcomed by the repair and maintenance workers.

Most of the conventional working lights available in the market are designed to have only one single mounting manner or for use in a specific condition. Consumers usually have to buy their working lights which can best meet their actual needs in a specific working place. Most of these working lights are fixedly attached to a certain place by holding means, hanging rings, hooks or connecting rods. A main drawback existed in these conventional working lights is, since they can usually be fixed to a place by only one type of fixture, they are not suitable for use at different places. To meet different needs in different places, consumers have to buy more than one working lights. This is, of course, not economical and will require considerable room to store the working lights when they are not in use.

It is therefore tried by the inventor to develop a hand tool case with a detachably connected working light to eliminate the drawbacks existing in the conventional working lights, so that the working light can be conveniently used at any place at any time and can be easily and savely stored in the hand tool case without occupying additional room.

SUMMARY OF THE INVENTION

A primary object of the present invention is to provide a hand tool case with a detachably connected working light. The working light is connected to a mounting bracket which is in turn connected to a movable frame pivotally connected to the hand tool case. The movable frame can be turned between a horizontal position in the hand tool case and an upright position protruding beyond the case. When the movable frame is in the horizontal position, the working light connected thereto can be located in the hand tool case for save storage therein. And, when the movable frame is in the upright position, the working light can be angularly adjusted relative to the mounting bracket to provide light in a desired manner. A shallow container for accommodating various parts can be removably positioned in the hand tool case while serves as an additional means to securely hold the upright movable frame in place. The working light can be removed from the mounting bracket and connected to other holding appliances for clamping on or hanging from a suitable place to advantageously provide light in different work sites.

BRIEF DESCRIPTION OF THE DRAWINGS

The present invention can be best understood by referring to the following detailed description of the preferred embodiment and the accompanying drawings, wherein.

DETAILED DESCRIPTION OF THE PREFERRED EMBODIMENTS

Figure 1:
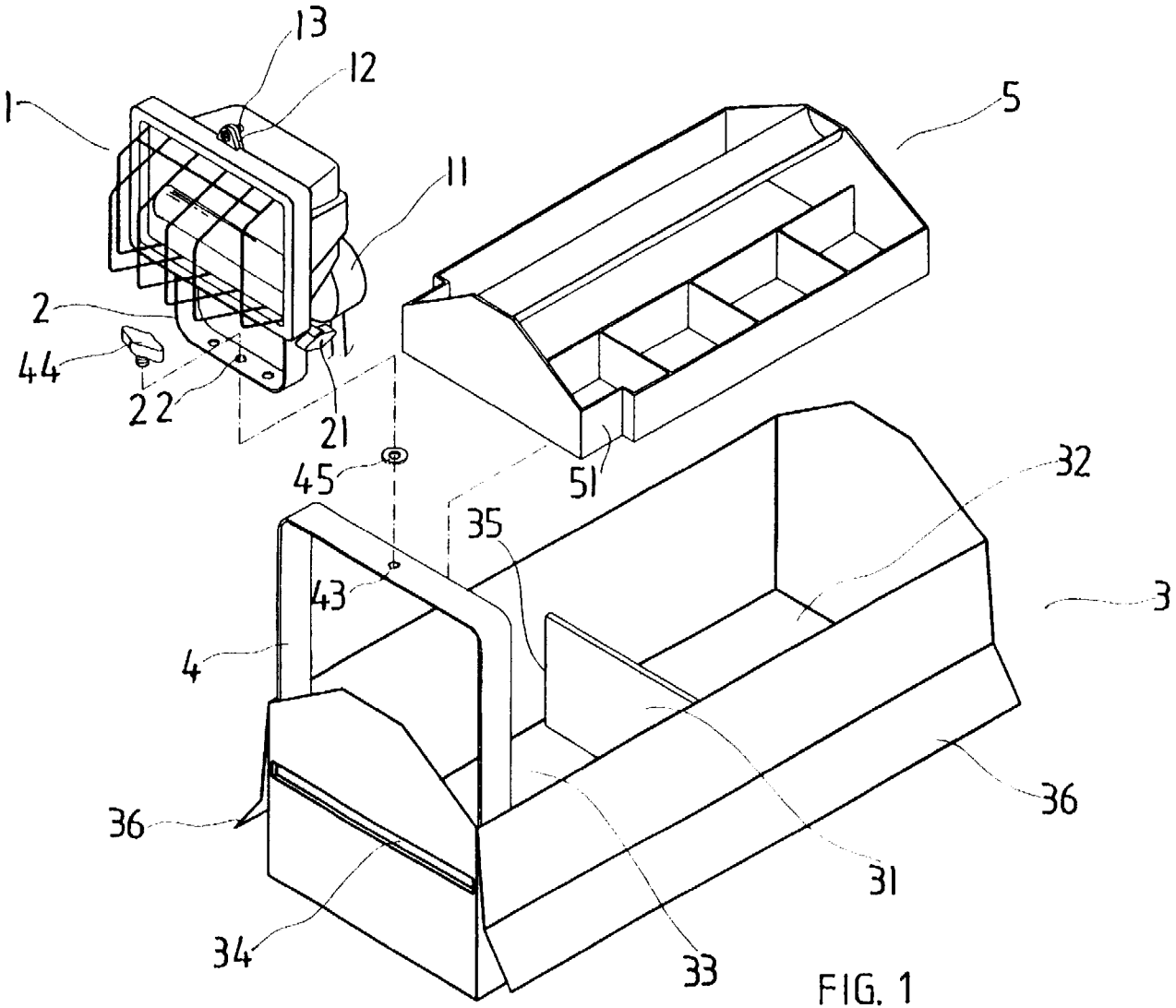
FIG. 1 is an exploded perspective of the present invention.
Figure 2:
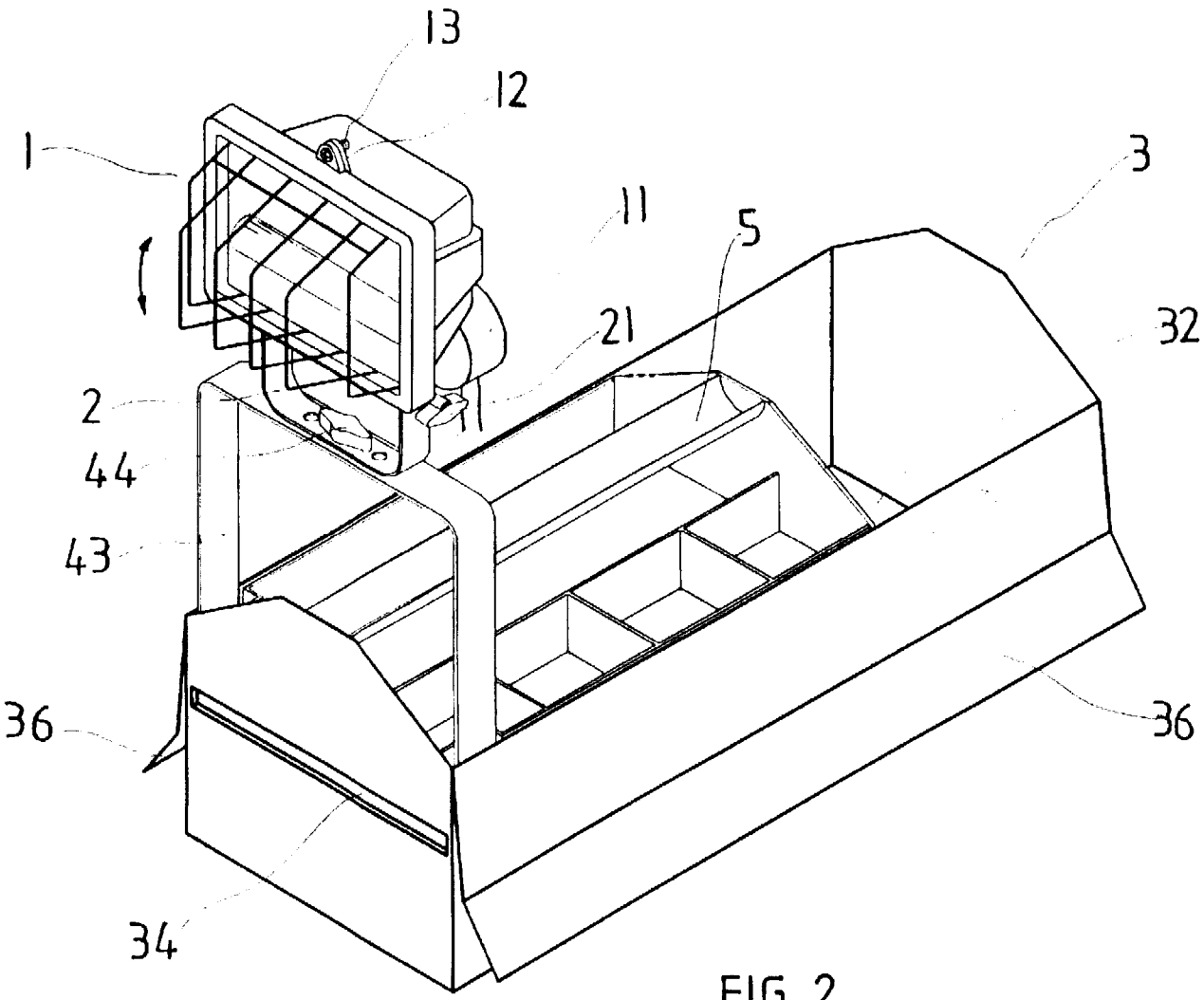
FIG. 2 is an assembled perspective of the present invention, showing the working light being connected to the movable frame in an upright position.

Please refer to FIGS. 1 and 2. The present invention mainly includes a working light 1 having a mounting bracket 2 angular adjustably connected to the working light 1 by means of adjusting screws 21, and a hand tool case 3 having two hinged top covers 36.

The working light 1 is connected to a power cord via a watertight wiring case 11. However, the working light 1 can be powered either by a DC or an AC power source. When the working light 1 is used to work in a car, it may also be plugged into a cigarette lighter in the car to obtain necessary power. The mounting bracket 2 is a U-shaped member having screw holes (not shown) provided at two free ends for the adjusting screws 21 to thread through and thereby adjustably secure the bracket 2 to the working light 1. At least one through holes 22 is formed on a flat middle portion of the mounting bracket 2.

Figure 3:
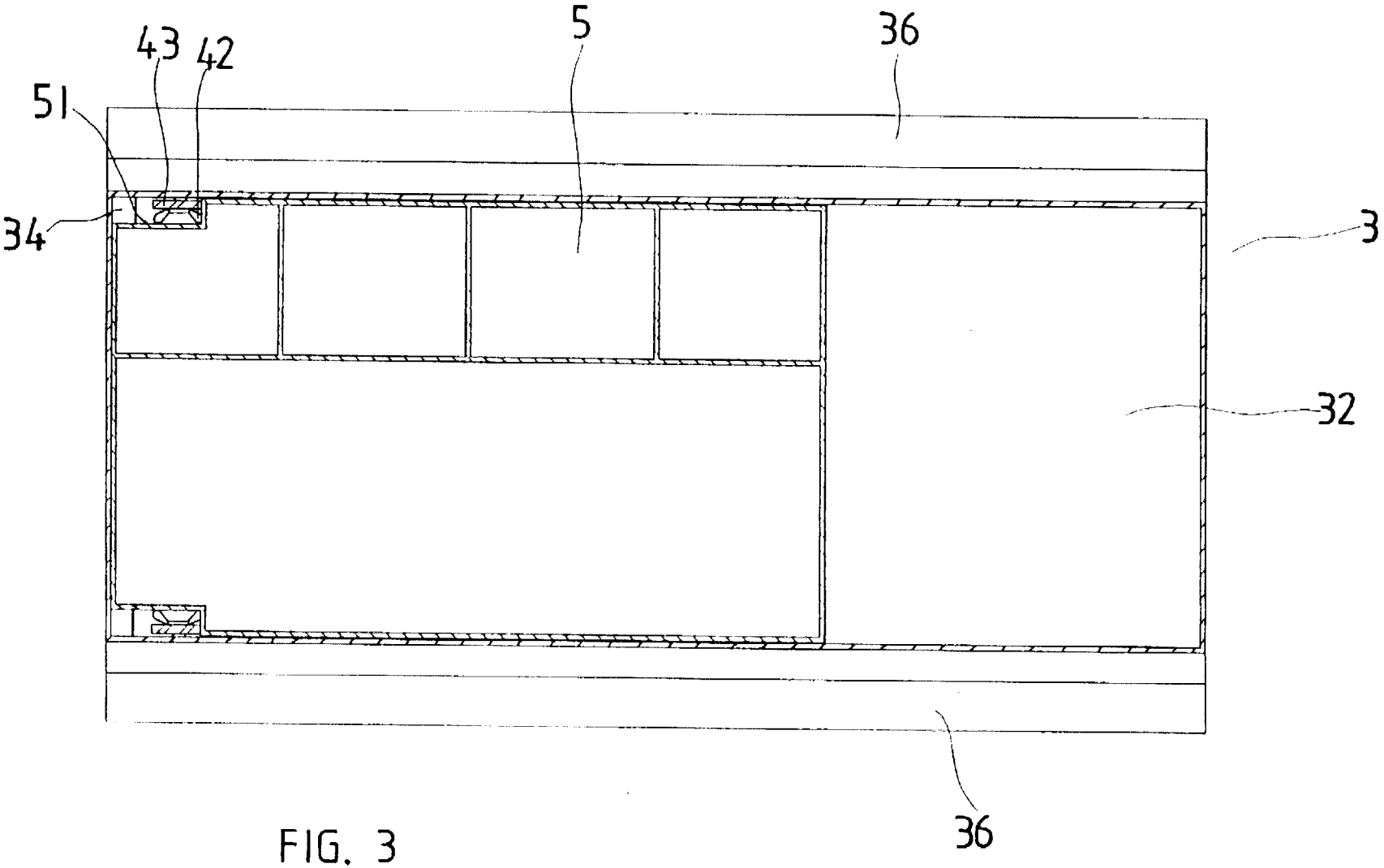
FIG. 3 is a top plan view of the assembled hand tool case of FIG. 2 with the working light and the movable frame removed.
Figure 4:
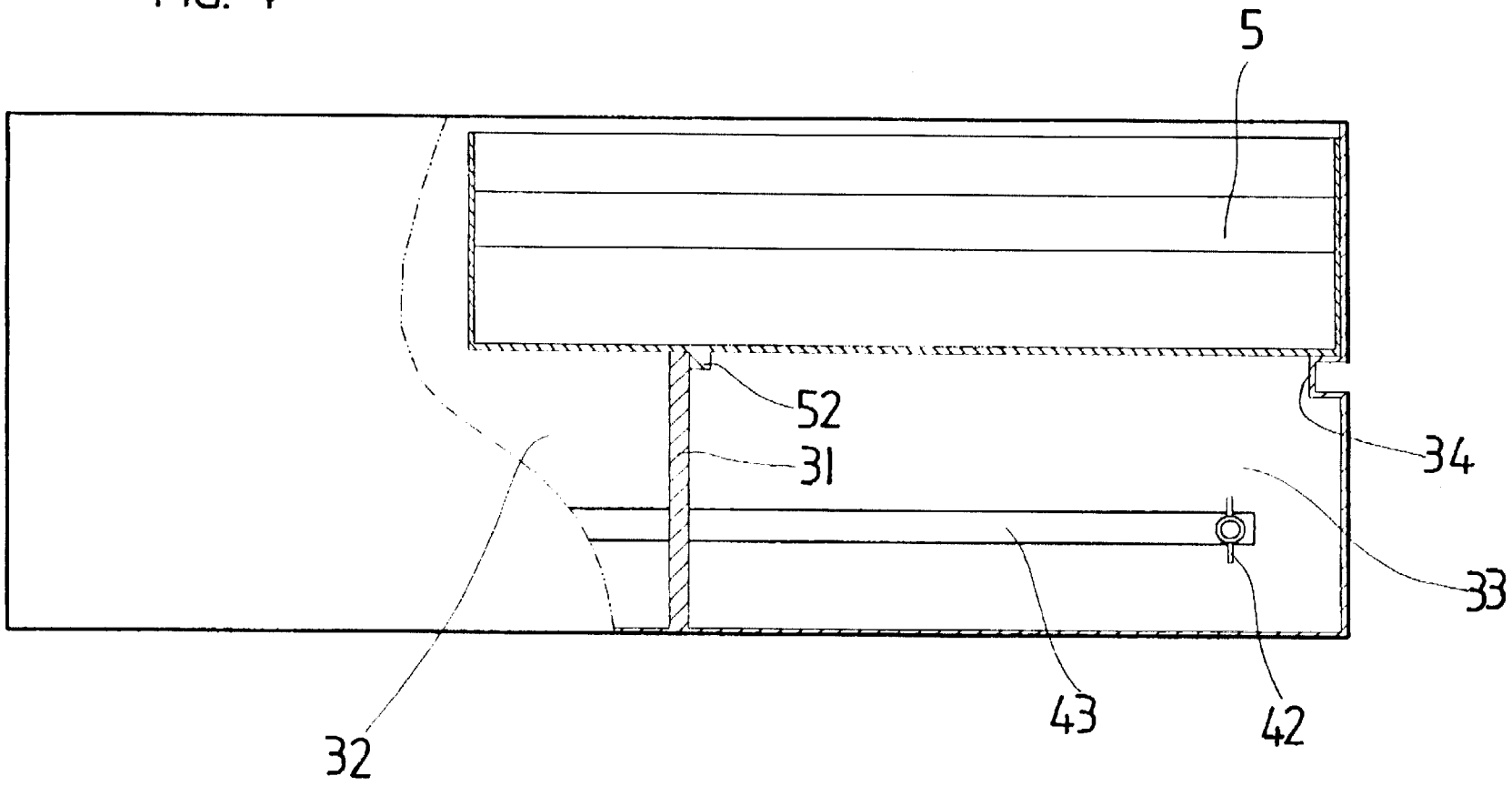
FIG. 4 is a partially sectional side view of the hand tool case of FIG. 2 viewing from a longitudinally extended side wall thereof.
Figure 5:
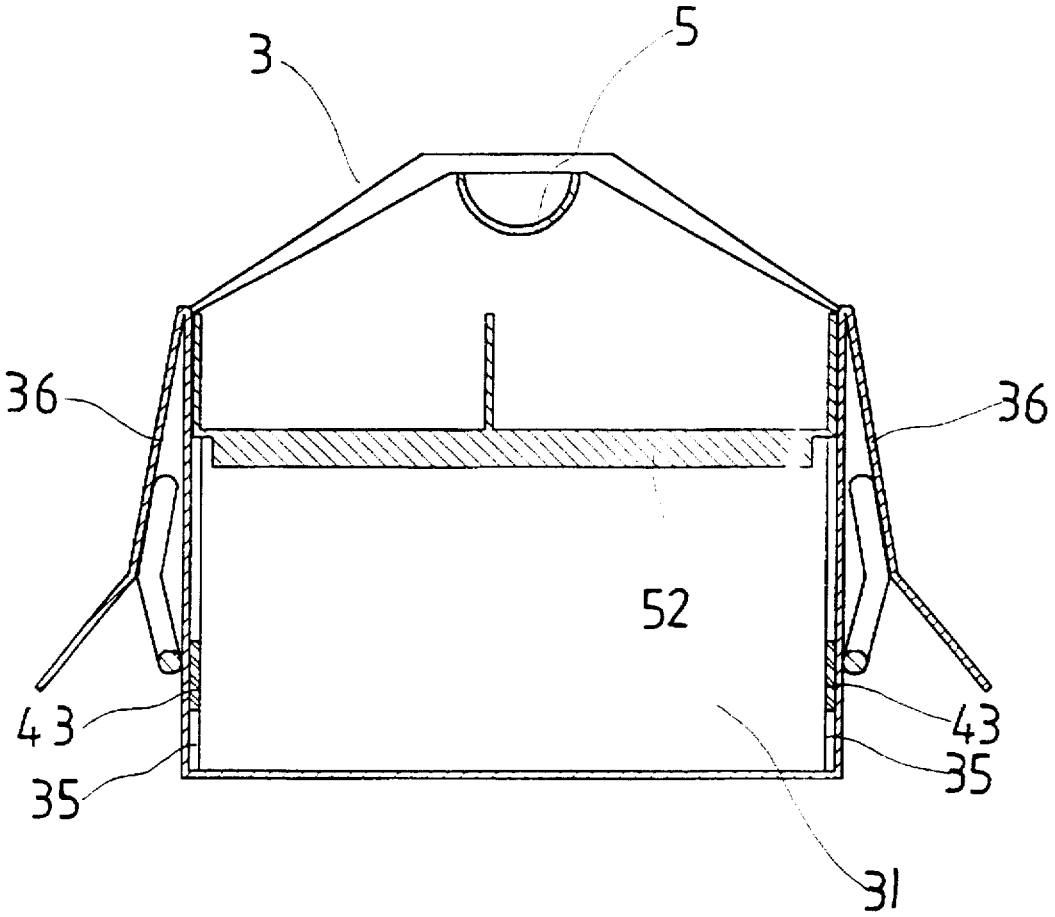
FIG. 5 is a partially sectional end view of the hand tool case of FIG. 2 viewing from a transversely extended end wall thereof.

The hand tool case 3 has a vertical partition 31 transversly located at a suitable position in the case 3 to divide an interior of the case 3 into a first space 32 and a second space 33 which respectively have a predetermined volume. One end wall of the hand tool case 3 is provided at a height corresponding to a top of the partition 31 with an inward projected portion 34. Two clearances 35 are left between two vertical edges of the partition 31 and two longitudinal side walls of the case 3. The clearance 35 each is large enough to receive therein two arms of an n-shaped movable frame 4 pivotally connected to the case 3 in the second space 33. The movable frame 4 is pivotally connected at free ends of two arms to two lower inner corners of two side walls of the case 3 adjacent to the end wall with inward projected portion 34 by threading screws 41 through holes formed on the free ends of the two arms to press against the side walls of the case 3 and be secured thereto by two thumb nuts 42, as shown in FIG. 3. A shallow container 5 with compartments for holding small hand tools, accessories, small screws or other frequently used hardware is disposed in the case 3 over the second space 33 and is supported at two longitudinal ends separately by the projected portion 34 and the vertically erected partition 31. To allow the movable frame 4 to be pivotally turned from a horizontal position in the case 3 to an upright position to protrude beyond the case 3, the container 5 is formed at two corners adjacent to the end wall with inward projected portion 34 with two symmetrical recesses 51 for accommodating two arms of the movable frame 4 in the upright position. Please refer to FIGS. 4 and 5, the container 5 is provided at a bottom surface near one longitudinal end with a downward projected rib 52 transversely extending across the bottom of the container 5. The rib 52 is so located that it will fall into the second space 33 to abut against the top of the partition 31 when the container 5 is put into the case 3 above the second space 33, so that the container 5 is stably supported on the partition 31 and the projected portion 34 without easily moving around. When the movable frame 4 is in the upright position for the working light 1 connected thereto to lighten a work site, as shown in FIG. 2, the two recesses 51 further serve as an additional means to firmly hold the movable frame 4 in the upright position without unexpectedly tilting over. Moreover, the movable frame 4 pivotally connected to the case 3 can be further firmly but adjustably secured to the case 3 by means of thumb nuts 42.

Figure 6:
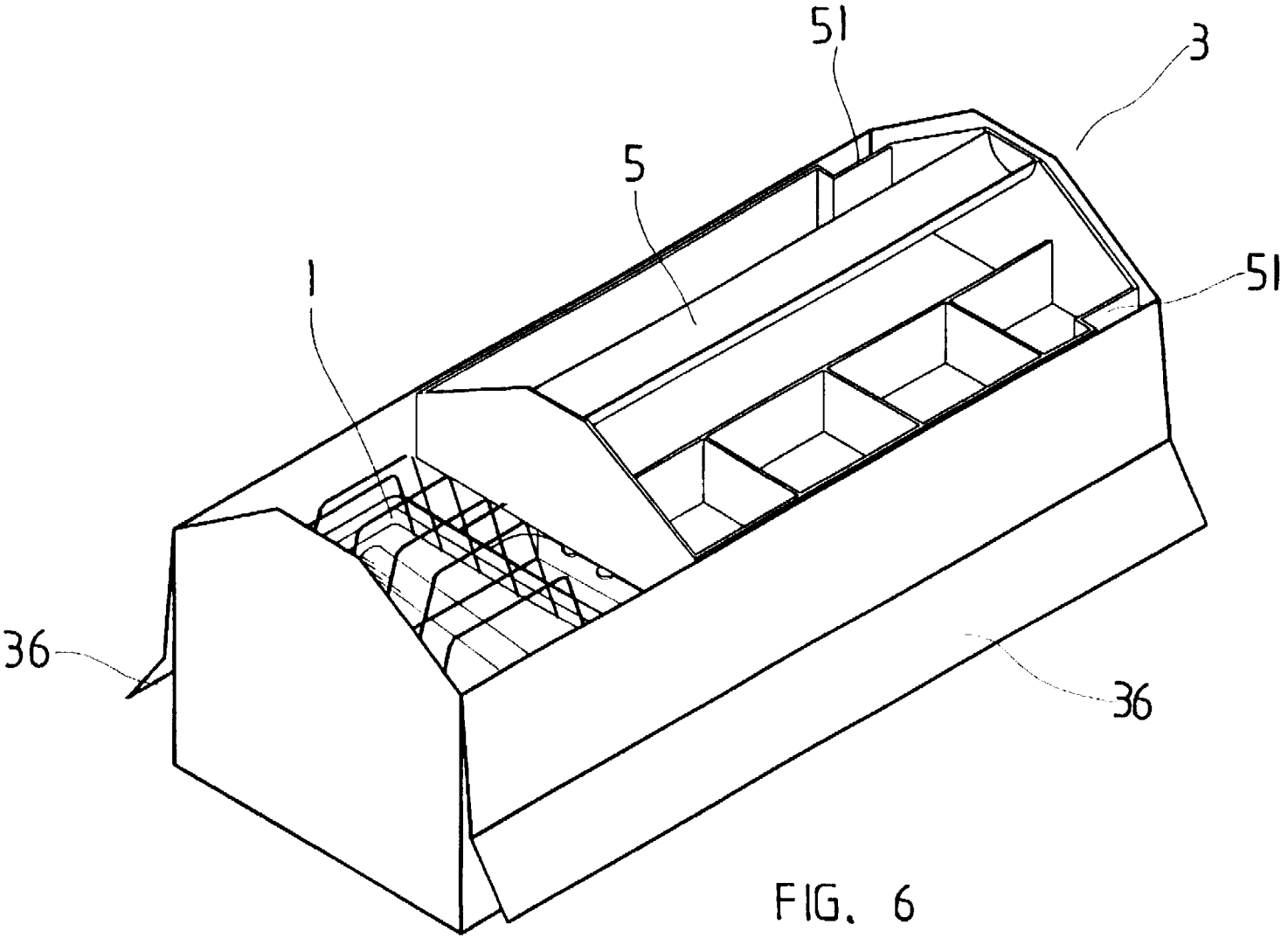
FIG. 6 is a perspective of the hand tool case with the working light received in the case.
Figure 7:
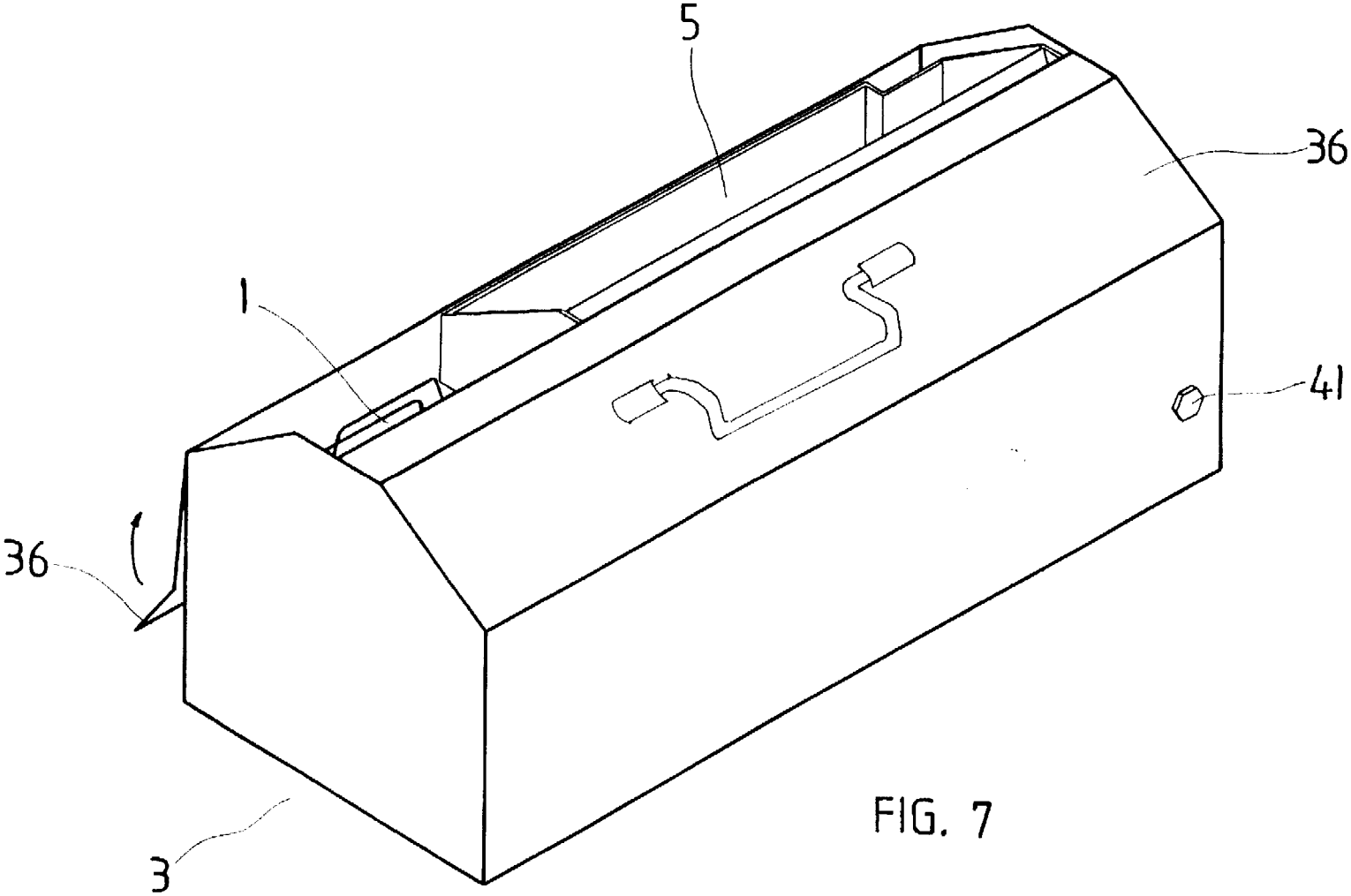
FIG. 7 is a perspective of the hand tool case with the working light received in the case and one of the hinged covers closed to a top of the case.

Please refer to FIG. 6. When the working light 1 is not in use, it can be received in the case 3 in the first space 32 by taking the container 5 out of the case 3 and loosening the thumb nuts 42 to lay the movable frame 4 in the horizontal position, so that the working light 1 attached to a flat top of the frame 4 just locates in the first space 32. Then, the container 5 is replaced in the case 3 over the second space 33, as shown in FIG. 6. Finally, the two hinged top covers 36 can be closed to the case 3 to complete the whole storage operation.

Figure 8:
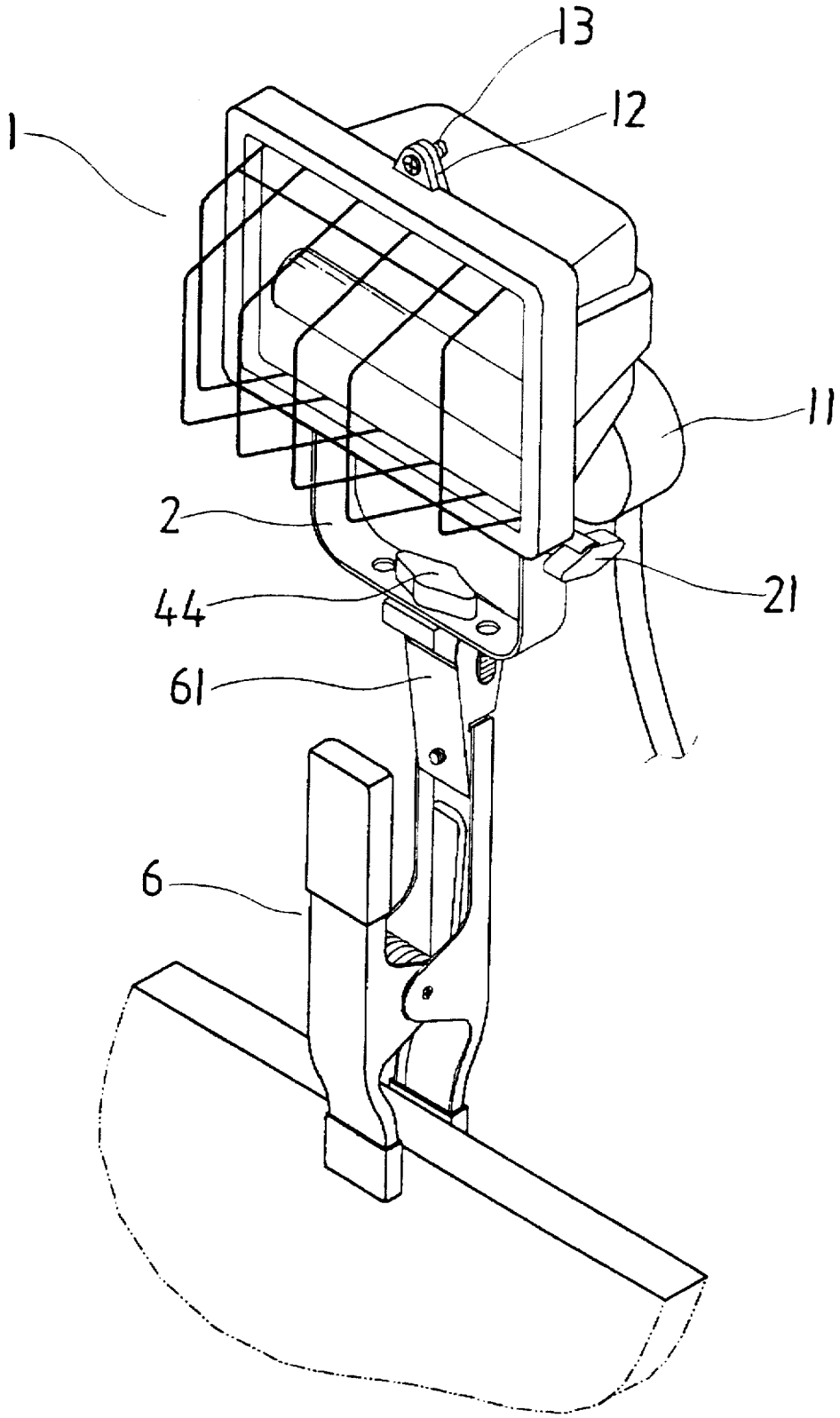
FIG. 8 is a perspective showing the working light has been separated from the hand tool case and is fixed to some other place by means of a holding appliance, which is a heavy duty clip in the drawing.

FIG. 8 illustrates the working light 1 of the present invention is removed from the movable frame 4 to be located at some other desired place for use. To secure the separated working light 1 to another desired place, a holding appliance 6, such as a heavy duty clip, is connected at a connecting block 61 provided to a top end of the clip to the mounting bracket 2 of the working light 1 by threading a check screw 44 through the hole 22 and into the connecting block 61. Then, attach the holding appliance 6 to a desired place to hold the working light 1 in place. By this way, the working light 1 can be advantageously used at different places to meet different needs.

Figure 9:
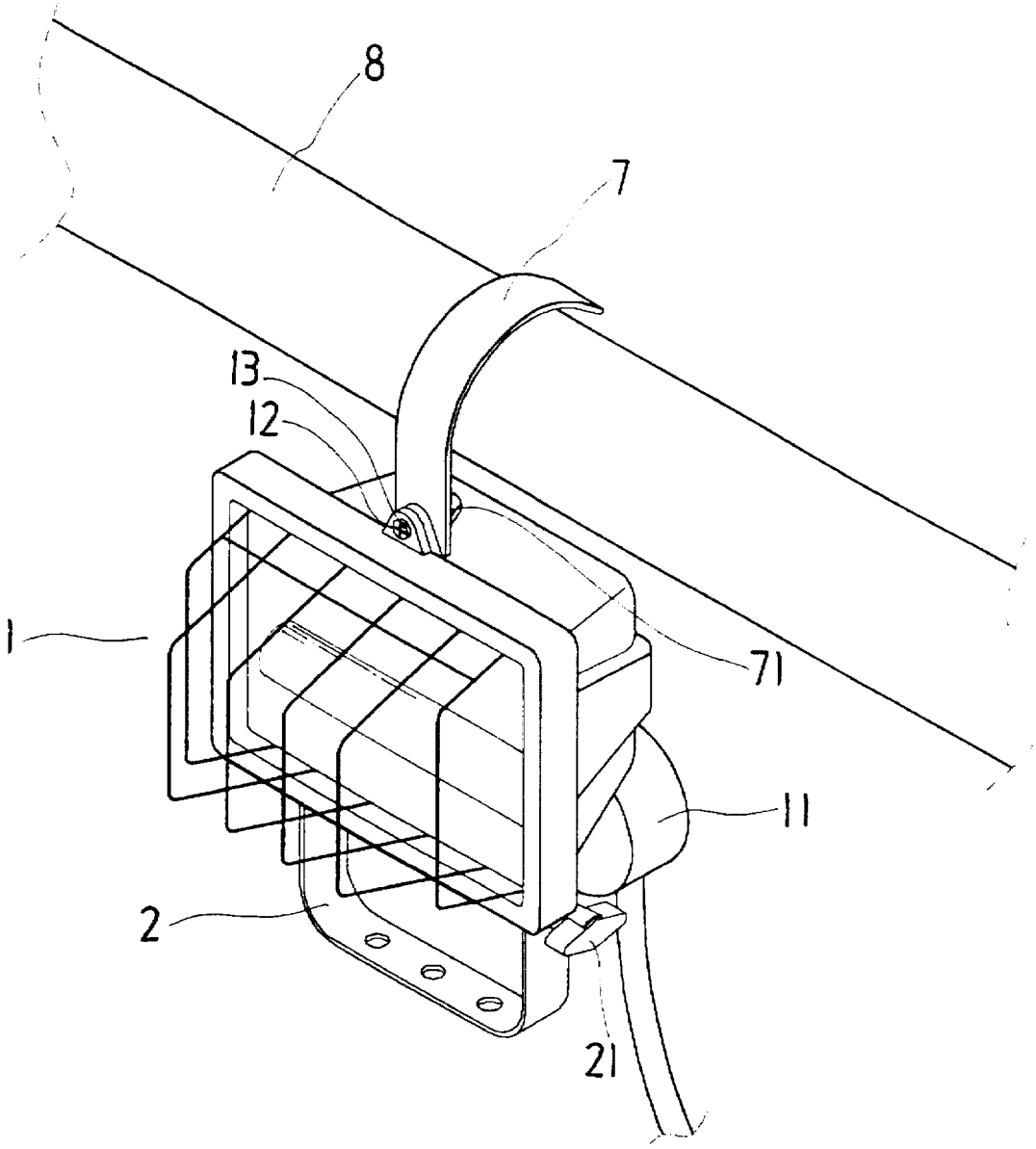
FIG. 9 is a perspective showing the working light has been separated from the hand tool case and is fixed to some other place by means of a hook.

As shown in FIG. 9, a hook 7 is secured to top connecting blocks 12 on the working light 1 by a screw 13 and a thumb nut 71 tightened against the screw 13. The separated working light 1 of the present invention can therefore be hung from or hooked onto a rod 8 or other suitable place with the hook 7.

With the above arrangements, the working light 1 of the present invention is allowed to be conveniently located at different places in various manners as desired, so that it may fulfill different requirements in different work sites.

What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. A hand tool case with a detachably connected working light, comprising:

a working light for providing light needed in a work site and having top connecting blocks formed at a peripheral frame of the working light for a fixing screw to thread therethrough;

a mounting bracket being angular adjustably connected at free ends to said working light at proper positions by means of adjusting screws, such that said working light may be firmly secured to said mounting bracket at a desired angle relative to said mounting barcket, and at least one connecting hole being formed on a lower flat portion of said mounting bracket;

a hand tool case having a transversely extended internal partition which vertically divides an interior of said hand tool case into a first and a second space, an end wall of said hand tool case adjacent to said second space being formed of an inward projected portion at a height corresponding to a top of said partition, and clearances being left between two vertical end edges of said partition and two side walls of said hand tool case;

a movable frame being pivotally connected at free ends to inner corners of said hand tool case adjacent to said end wall having said inward projected portion, such that said movable frame can be turned between a horizontal position in said hand tool case and an upright position protruding beyond said hand tool case, said movable frame being provided at a flat top portion with a fixing hole for a check screw to thread through and into one of said connecting holes on said mounting bracket to thereby connect said mounting bracket to said movable frame; and a shallow container for accommodating hand tools, parts, accessories, and/or other frequently used hardware, said shallow container being disposed in said hand tool case above said second space with a lower end of said container supported on said inward projected portion of said end wall adjacent to said second space and the other lower end on said top of said internal partition, two recesses being formed on said shallow container at two lower corners thereof adjacent to said movable frame for said movable frame in said upright position to extend therethrough and be firmly locked thereto, and a downward projected rib transversely extending across a bottom surface of said shallow container within said second space to just abut against said top of said partition;

whereby said working light can be fixed to and above said hand tool case for use when said mounting bracket being angular adjustably connected to said working light is secured to said movable frame having been turned to said upright position; and whereby when said working light is not in use, it can be received in said first space in said hand tool case by removing said shallow container out of the hand tool case, and then loosening and turning said movable frame to said horizontal position in said hand tool case via clearances between said internal partition and said side walls of said case, so that said working light along with said mounting bracket are just located in said first space in the hand tool case for save storage therein.

2. A hand tool case with a detachably connected working light as claimed in claim 1, wherein said mounting bracket is a U-shaped member.

3. A hand tool case with a detachably connected working light as claimed in claim 1, wherein said movable frame is an n-shaped member.

4. A hand tool case with a detachably connected working light as claimed in claim 1, wherein said movable frame is pivotally connected to said hand tool case by means of screws and thumb nuts.

* * * * *